US008302611B2

(12) United States Patent
Rowley

(10) Patent No.: US 8,302,611 B2
(45) Date of Patent: Nov. 6, 2012

(54) ANTI-SMOKING DEVICE

(76) Inventor: Thomas J. Rowley, Stafford (GB)

( * ) Notice: Subject to any disclaimer, the term of this patent is extended or adjusted under 35 U.S.C. 154(b) by 478 days.

(21) Appl. No.: 12/449,536

(22) PCT Filed: Feb. 12, 2008

(86) PCT No.: PCT/GB2008/000463

§ 371 (c)(1),
(2), (4) Date: Aug. 12, 2009

(87) PCT Pub. No.: WO2008/099147

PCT Pub. Date: Aug. 21, 2008

(65) Prior Publication Data

US 2009/0320864 A1 Dec. 31, 2009

(30) Foreign Application Priority Data

Feb. 17, 2007 (GB) ..... 0703152.9

(51) Int. Cl.
*A24F 47/00* (2006.01)
*A24F 13/02* (2006.01)

(52) U.S. Cl. ..... 131/272; 131/270; 131/187

(58) Field of Classification Search ..... 131/175, 131/187, 270, 272

See application file for complete search history.

(56) References Cited

U.S. PATENT DOCUMENTS

| | | | | |
|---|---|---|---|---|
| 2,679,251 A | | 5/1954 | Simmer | |
| 3,260,266 A | * | 7/1966 | Miller | 131/187 |
| 3,646,944 A | * | 3/1972 | Banoczi | 131/187 |
| 3,812,865 A | * | 5/1974 | Anderson | 131/272 |
| 4,034,767 A | | 7/1977 | DePinto | |
| 4,446,877 A | | 5/1984 | Aikman | |
| 4,572,217 A | * | 2/1986 | Newman et al. | 131/175 |
| 5,915,388 A | | 6/1999 | Bowen et al. | |

FOREIGN PATENT DOCUMENTS

DE 103 34 379 A1 3/2005

* cited by examiner

*Primary Examiner* — Richard Crispino
*Assistant Examiner* — Dionne Walls Mayes
(74) *Attorney, Agent, or Firm* — Rodgers & Rodgers

(57) ABSTRACT

This invention relates to a device which functions as a cigarette holder and can reduce the intake of cigarette smoke into the lungs of a user. The holder is substantially tubular and has a first end (14) for mounting a cigarette, the first end having an annular wall (12) with an internal dimension larger than the diameter of the cigarette, the annular wall carrying a plurality of inwardly-directed longitudinal ribs (20) adapted to engage and support the cigarette. Between the ribs are passageways which can allow the flow of air along the outside of the cigarette into the mouth of the user, so that the volume of smoke breathed in by the user can be reduced.

20 Claims, 1 Drawing Sheet

26
16
A
A
20
26
24

L/2
L/2
12
20

10
16
12
20
14

B
B
12
22

12
20
24
14

ANTI-SMOKING DEVICE

FIELD OF THE INVENTION

This invention relates to an anti-smoking device, and in particular to a device which functions as a cigarette holder and can reduce the intake of cigarette smoke into the lungs of a user.

BACKGROUND OF THE INVENTION

The smoking of cigarettes is a popular habit around the world, and is widely considered to be an addiction caused by the user's dependency upon the nicotine in the tobacco smoke. Thus, while most smokers know of the harmful effects of smoking upon themselves and others around them, many are unable to give up the habit even though they wish to do so.

DESCRIPTION OF THE PRIOR ART

Many devices are known to assist smokers with giving up the habit of smoking.

One class of devices includes nicotine gum and nicotine patches, which enable a user to satisfy a nicotine addiction without incurring the detrimental effects of inhaling cigarette smoke.

Another class of devices seek to satisfy the user's habit of holding a cigarette in his or her hand and/or lips, by providing a dummy cigarette which can be held in the same way.

Most cigarettes have a filter tip which is provided between the tobacco and the user, the filter tip being provided in an attempt to filter out some of the harmful substances in the smoke before the smoke reaches the user. The filter tip is surrounded by layer of paper and in some cigarettes the paper layer has many small perforations which allow air to be drawn into the filter directly rather than through the tobacco. In effect therefore, when a user is smoking such a cigarette (often called a "low tar" cigarette), whilst most of the air drawn in passes through the tobacco and therefore contains smoke, at least some is drawn in through the perforations and contain's no smoke.

Yet another class of known devices share this principle of allowing air into the breath so as to reduce the proportion of smoke therein. The present invention relates to this class of anti-smoking devices.

One known device in this class is described in French patent application FR-2694166, which provides a cigarette with a number of lateral openings through which air can enter the cigarette (in effect replacing the perforations of a low tar cigarette with a small number of larger openings). The cigarette carries a sleeve which can be moved relative to the lateral openings to block or unblock the openings. The user selects the number (or proportion) of the openings which are unblocked and when the user breathes in through the cigarette a proportion of the breath which would otherwise be drawn through the tobacco is instead drawn through the unblocked openings. In this way, the proportion of the user's breath which contains smoke (and hence the harmful and/or addictive substances contained therein) is reduced according to the position of the sleeve in relation to the openings.

A similar device is disclosed in Romanian patent application RO-120880, which utilises a holder into which a standard cigarette can be inserted, the holder having lateral openings which can be selectively opened or closed by the user.

A major disadvantage of the device of FR-2694166 is that the cigarette needs to be modified significantly, and the cost of each cigarette is thereby considerably increased. Cigarette manufacturers need to make an additional type of cigarette designed solely for those users who wish to benefit from the device of this document.

A major disadvantage of the device of RO-120880 is that the filter tip of the cigarette is necessarily inserted into the holder, and if the filter tip contains perforations the holder blocks some or all of those perforations. The advantage of providing lateral openings in the holder is therefore reduced by blocking the perforations surrounding the filter tip.

A major disadvantage of both of the described devices is that the lateral openings are often blocked by the user's fingers. Thus, while the user is holding the cigarette in his or her mouth, care must be taken to ensure that the fingers do not block the lateral openings. If the lateral openings are even partly blocked by the users fingers, then the proportion of smoke in each breath will be increased, perhaps to the level of a conventional cigarette. An attempt to gradually reduce a user's smoke intake by gradually increasing the open area of the lateral openings will be undermined by partial or total blockage of the openings by the user's fingers.

The present invention seeks to provide an anti-smoking device which avoids or reduces the disadvantages associated with the prior art devices.

SUMMARY OF THE INVENTION

According to the invention, there is provided an anti-smoking device comprising a cigarette holder, the cigarette holder being substantially tubular and having a first end for mounting a cigarette, the first end having an annular wall with an internal dimension larger than the diameter of the cigarette, the annular wall carrying a plurality of inwardly-directed ribs adapted to engage the cigarette.

Because the internal dimension of the annular wall is larger than the diameter of the cigarette air can be drawn into the first end around the outside of the cigarette, i.e. between the internal ribs.

The present invention therefore avoids the use of lateral openings, and instead uses longitudinal passageways allowing air to pass longitudinally along the outside of the cigarette.

Preferably, the ribs engage only a small proportion of the circumference of the cigarette. This is doubly-advantageous in that the ribs are likely to block only a very small proportion of any perforations in the paper layer surrounding the filter tip, and the regions between the ribs can be used to allow the passage of air along the outside of the cigarette.

The ribs can extend along the full length of the holder, so that air can pass along the outside of the cigarette throughout the full length of the holder (from its first end and into the mouth of the user in use). Alternatively, respective walls are provided between at least some of the ribs so as to block off the air flow between is those ribs. The presence or absence of a wall between adjacent ribs can be used to determine the volume of air which can be drawn in with each breath, and in particular the proportion of air passing along the outside of the cigarette as opposed to the proportion of air passing through the tobacco.

In a preferred embodiment the walls are breakable, and the holder is initially provided with walls between all of the ribs, or between all but one of the ribs. When the user smokes a cigarette with such a holder only a small proportion of each breath will pass along the outside of the cigarette and contain no smoke, and so the user will effectively be smoking as normal. This can represent the first stage of the user's attempt to stop smoking.

As the user becomes accustomed to breathing in less smoke with each breath, he or she can remove another wall so as to further reduce the volume of smoke in each breath, and so on.

Alternatively, six separate holders can be provided with increasing area passageways around the cigarette, each holder being used in turn as the user becomes accustomed to breathing in less smoke.

Desirably, the wall(s) can also provide a limiting stop for insertion of the cigarette into the holder.

BRIEF DESCRIPTION OF THE PREFERRED EMBODIMENTS

The invention will now be described in more detail, by way of example, with reference to the accompanying drawings, in which.

DETAILED DESCRIPTION

Figures 1, 2, 3, 4, 5, 6:
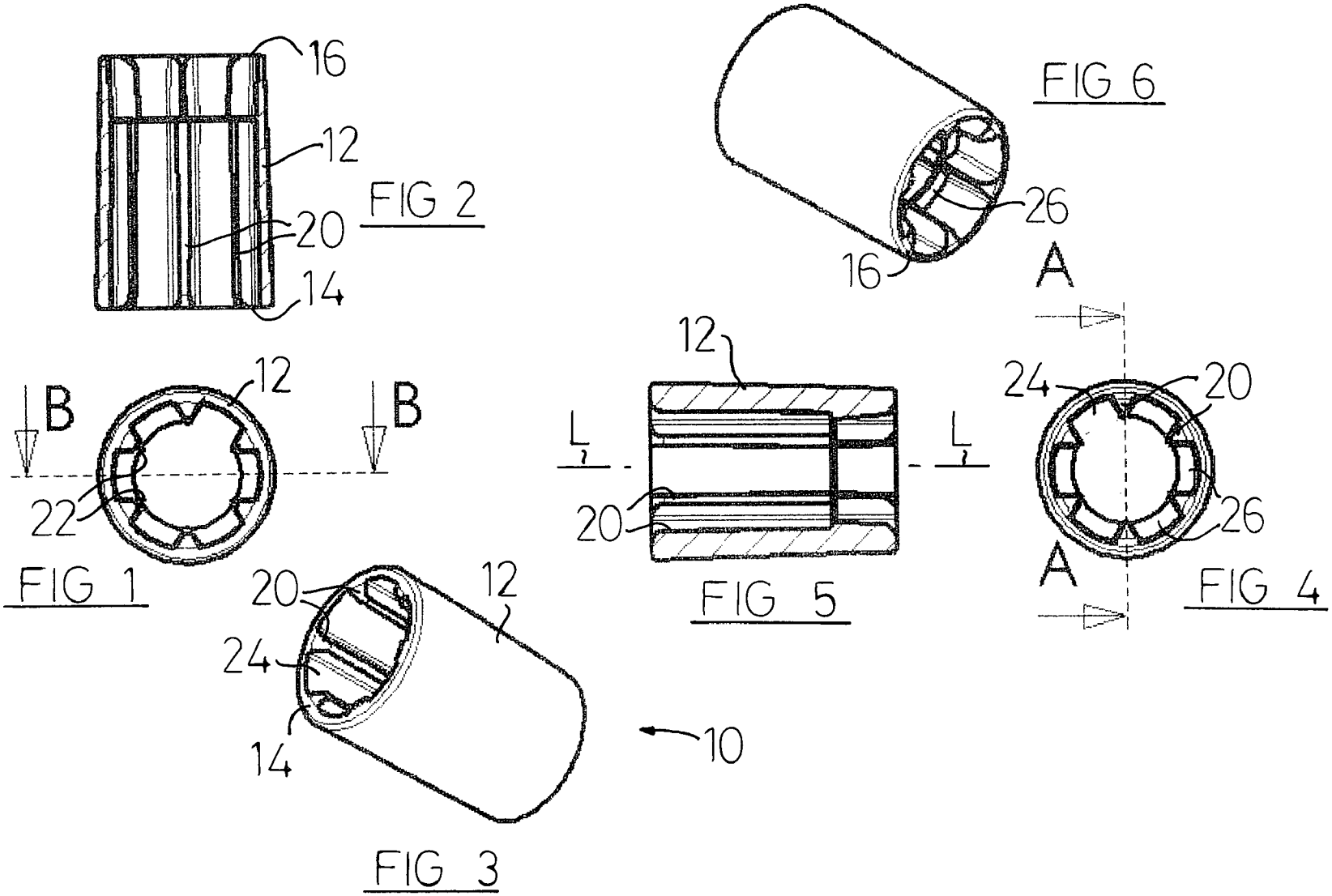
FIG. 1 shows an end view of a cigarette holder according to the invention, from the first end.
FIG. 2 shows a cross-section along the line B-B of FIG. 1.
FIG. 3 shows a perspective view of the holder, from the first end
FIG. 4 shows an end view of the cigarette holder, from the second end.
FIG. 5 shows a cross-section along the line A-A of FIG. 4.
FIG. 6 shows a perspective view of the holder, from the second end.

The holder 10 shown in FIGS. 1-6 is substantially tubular, with an annular wall 12. The holder has a first end 14 which is adapted to receive and support a cigarette (not shown), and specifically the filter tip or end of the cigarette which would ordinarily be placed between the user's lips (also not shown).

The holder 10 has a second end 16 which in use will be placed between the user's lips.

The diameter of the annular wall 12 is larger than the outside diameter of a cigarette. In particular, the diameter of a standard cigarette is 8 mm, and the inner diameter of the annular wall 12 is around 10 mm, and the outer diameter is around 11.5 mm. Accordingly, when a cigarette is inserted into the first end 14 of the holder 10, there is substantially a 1 mm gap between the annular wall 12 and the periphery of the cigarette.

In order to support the cigarette a number of internal ribs 20 are provided upon the annular wall 12. In this embodiment there are six ribs 20, but other embodiments can have three, four, five, or more ribs. As better seen in FIGS. 1 and 4 the ribs 20 are substantially triangular in cross-section and terminate at peaks 22 which peaks lie substantially parallel with the longitudinal axis L-L of the holder 10.

The peaks 22 could if desired lie exactly parallel to the longitudinal axis L-L, but in the embodiment shown the holder 10 is slightly tapered, so that the peaks 22 lie on a circle with a diameter of approximately 7.8 mm at the first end 14, converging to a diameter of approximately 7.6 mm (and the wall 12 converges similarly).

The diameter of the circle containing the peaks at the first end 14 is therefore slightly smaller than the diameter of a cigarette, so that in use the ribs 20 deform the periphery of the cigarette slightly so as to ensure the support thereof.

The ribs 20 can if desired have their peaks rounded or flattened so as to reduce the likelihood that the paper layer surrounding the filter tip will be tom as the cigarette is inserted into the holder. However, it is desired that the ribs be substantially sharp so that the area of the paper layer which they cover is minimised, so as to minimise the blockage of any perforations which are present in the paper layer, and allow the passage of air through those perforations as intended.

It will therefore be understood that the ribs 20 act to hold a cigarette substantially centrally within the holder, with the annular wall 12 spaced from the periphery of the cigarette. Accordingly, the regions between the ribs 20 provide passageways 24 along which air can pass along the outside of the cigarette.

It will be seen from FIGS. 2 and 5 in particular that the ribs 20 extend from the first end 14 to the second end 16, but in other embodiments the ribs terminate away from either or both of the first and second ends.

Between the first end 14 and the second end 16 there is a series of walls 26, each wall 26 lying between a pair of adjacent ribs 20. The walls 26 close off the respective passageways 24, and also provide a limitation to the insertion of the cigarette. Thus, in use it is intended that the cigarette will be inserted into the holder from the first end 14 until the filter tip engages the walls 26. The inner diameter of the walls in this embodiment is around 7.7 mm.

It will therefore be understood that when a cigarette is inserted into the holder 10, the walls 26 will close off the respective passageways 24, so that air cannot flow along those particular passageways from the first end 14 to the second end 16. However, in the embodiment shown one wall is not present (or has been removed), so that the passageway numbered 24 in FIG. 4 is open, and air can flow along that passageway from the first end 14 to the second end 16.

The air flowing along the open passageway 24, in addition to any air flowing though any perforations in the paper layer surrounding the filter tip, will therefore contain little or no smoke, and the proportion of smoke in the breath taken by the user will be correspondingly reduced.

It will be understood that different holders can be provided with different numbers of walls removed, or else the walls 26 could be designed to be breakable so that the user can increase the number of open passageways 24 as desired.

It is preferably arranged that the combined cross-sectional area of all of the passageways 24 (when a cigarette is present) is around 15 $mm^2$. The cross-sectional area of a cigarette is around 50 $mm^2$. However, the resistance to air flow through the tobacco and filter tip is much greater than that through the passageways, and it is believed that if all of the passageways 24 are open the user will in practice breathe in little or no smoke, i.e. substantially all of the air taken in will pass through the passageways 24 and not through the tobacco.

In the embodiment shown the holder 10 has six ribs 20, and therefore can have up to six walls 26. Six different holders can be provided in a set, with none, one, two, three, four and five walls 26 present, and the user can use the holder with five walls 26 until he or she is accustomed to the reduced smoke intake, and then move onto the holder with four walls 26 present and so on, in an attempt to overcome the addiction to smoking.

Alternatively, a single holder can be provided with breakable walls 26 as above described.

A holder could of course be provided with all six walls 26 present. The use of such a holder would not reduce the proportion of smoke in each breath as all of the passageways 24 would be closed, but it may be necessary or desired by some users so that they become accustomed to using a holder.

Since the holder 10 is tapered, its second end 16 is not much larger than the filter tip of a cigarette. Also, it can be relatively short, (in this embodiment the distance between the first end 14 and the second end 16 is around 16 mm). The holder can be colored similar to the filter tip if it is desired to be substantially unobtrusive. The relatively short length of the holder 10 will ensure that in use the first end 14 is very close to the user's lips and there is little if any likelihood that the user will block any of the passageways 24 with his or her fingers.

The holder 10 is preferably made of a plastic material. Clearly, the material used must be "food-grade" or the like, i.e. suitable for holding between a person's lips.

The material must also not degrade in the presence of the materials in cigarette smoke.

The invention claimed is:

1. An anti-smoking device comprising a cigarette holder, the holder being substantially tubular and having a first end for mounting a cigarette, the first end having an annular wall with an internal dimension larger than the diameter of the cigarette, the annular wall carrying a plurality of inwardly-directed ribs adapted to engage and support the cigarette whereby the cigarette does not engage the annular wall in use, the holder having a longitudinal axis, each of the ribs having a respective free end, the free ends of the ribs together defining an approximate circle having a diameter which is smaller than the diameter of the cigarette whereby in use the ribs deform the cigarette, a transverse wall being provided between at least one pair of adjacent ribs, the transverse wall providing a stop limiting the insertion of the cigarette in which at least one other pair of adjacent ribs has no transverse wall therebetween whereby a passageway is provided along the holder between said at least one other pair of adjacent ribs.

2. An anti-smoking device according to claim 1 in which the ribs are adapted to engage only a small proportion of the circumference of the cigarette.

3. An anti-smoking device according to claim 1 in which the ribs extend longitudinally along the full length of the holder.

4. An anti-smoking device according to claim 1 in which there is a number of passageways, and in which the combined cross-sectional area of the passageways is around 15 $mm^2$.

5. An anti-smoking device according to claim 1 in which the annular wall is substantially circular in cross-section, and has an inner diameter at the first end of around 10 mm.

6. An anti-smoking device according to claim 1 in which the annular wail tapers inwardly from the first end.

7. An anti-smoking device according to claim 1 in which the free ends of the ribs together define an approximate circle having a diameter of around 7.8 mm at the first end.

8. An anti-smoking device according to claim 1 in which the free ends of the ribs taper inwardly from the first end.

9. An anti-smoking device according to claim 1 having a length of approximately 16 mm.

10. An anti-smoking device according to claim 1 in which said transverse wall is removable and/or breakable.

11. An anti-smoking device comprising a set of cigarette holders, each holder in the set being substantially tubular and having a first end for mounting a cigarette, the first end having an annular wall with an internal dimension larger than the diameter of the cigarette, the annular wall carrying a plurality of inwardly-directed ribs adapted to engage and support the cigarette whereby the cigarette does nor engage the annular wall in use, the holder having a longitudinal axis, each of the ribs having a respective free end, the free ends of the ribs together defining an approximate circle having a diameter which is smaller than the diameter of the cigarette whereby in use the rib deform the cigarette, a transverse wall being provided between at least one pair of adjacent ribs, the transverse wall providing a stop limiting the insertion of the cigarette, a first holder in the set having a first number of transverse walls between respective adjacent ribs, a second holder in the set having a second number of transverse walls between respective adjacent ribs, the first number being different to the second number.

12. An anti-smoking device according to claim 11 in which the ribs of each holder in the set are adapted to engage only a small proportion of the circumference of the cigarette.

13. An anti-smoking device according to claim 11 in which the ribs of each holder in the set extend longitudinally along the full length of the holder.

14. An anti-smoking device according to claim 11, each holder in the set having a number of passageways located between respective adjacent ribs, the total cross-sectional area of said passageways of the first holder in the set being different from that of the second holder in the set.

15. An anti-smoking device according to claim 11 in which the region between adjacent ribs of each holder in the set comprises a passageway for air, the combined cross-sectional area of all of the passageways of each holder in the set being around 15 $mm^2$.

16. An anti-smoking device according to claim 11 in which the annular wall is substantially circular in cross-section, and has an inner diameter at the first end of around 10 mm.

17. An anti-smoking device according to claim 16 in which the annular wall tapers inwardly from the first end.

18. An anti-smoking device according to claim 11 in which the free ends of the ribs together define an approximate circle having a diameter of around 7.8 mm at the first end.

19. An anti-smoking device according to claim 11 in which the free ends of the ribs of each holder in the set taper inwardly from the first end.

20. An anti-smoking device according to claim 11 in which each holder in the set has a length of approximately 16 mm.

* * * * *